United States Patent [19]

Swartzbaugh

[11] Patent Number: 4,610,372

[45] Date of Patent: Sep. 9, 1986

[54] SELF-SEALING CLOSURE FOR SMALL CONTAINERS

[75] Inventor: Peter T. Swartzbaugh, Toledo, Ohio

[73] Assignee: Owens-Illinois, Inc., Toledo, Ohio

[21] Appl. No.: 752,769

[22] Filed: Jul. 8, 1985

[51] Int. Cl.[4] ..... B65D 41/04

[52] U.S. Cl. ..... 220/288; 215/344

[58] Field of Search ..... 220/288; 215/329, 341, 215/342, 343, 344

[56] References Cited

U.S. PATENT DOCUMENTS

| | | | |
|---|---|---|---|
| 3,160,303 | 12/1964 | Healy | 215/344 |
| 3,382,996 | 5/1968 | Owens | 215/344 |
| 3,414,151 | 12/1968 | Morrison | 215/344 |

*Primary Examiner*—George T. Hall

*Attorney, Agent, or Firm*—John R. Nelson

[57] ABSTRACT

A molded thermoplastic linerless or self-sealing closure for use with a small container having a thin and accurately formed finish, such as a disposable glass or plastic culture tube. The closure has a top panel and an integrally formed depending annular skirt, and the annular skirt has an inwardly projecting helical thread to permit the closure to be screwed onto and off of a container with a threaded finish. The closure top panel has a thick central portion which is depressed below the top of the closure skirt and a thin annular portion that extends radially outwardly and upwardly from the central portion to the top of the closure skirt. The underside of the closure engages the rim of the container in a pocket formed by the annular portion and the annular skirt, and seals partially on the top of the rim and partially on the inside of it, with the thinness of the annular portion contributing to the deformability of the closure to help provide the required seal with the container.

22 Claims, 5 Drawing Figures

SELF-SEALING CLOSURE FOR SMALL CONTAINERS

BACKGROUND OF THE INVENTION

1. Field of the Invention

This invention relates to a self-sealing or unlined closure for a small container. More particularly, this invention relates to a self-sealing or unlined closure for a small, single use container of the type that has a thin and accurately formed closure engaging rim. Closures according to the present invention may be used to advantage with containers of the type known as culture tubes.

2. Description of the Prior Art

Self-sealing or unlined closures have been extensively used in the packaging of distilled spirits and various other comestible products. Such closures are normally applied to containers with fairly thick closure engaging rims, for example, glass containers which are formed by a blow molding process and plastic containers whose closure engaging finish portions are formed by blow molding or injection molding.

A self-sealing closure of the aforesaid type has a long thin flexible internal sealing fin which is adapted to engage a sealing surface on the top of the container finish, when the closure is applied to the finish, to form a suitable seal, even for a beverage container, without the need for a separate liner or lining material in the closure to effect the necessary seal. Examples of closures of this type are illustrated in U.S. Pat. No. 3,255,909 to Miller, et al., U.S. Pat. No. 4,069,937 to Smalley, and U.S. Pat. No. 4,360,114 to Owens.

Many packaging applications, however, utilize containers which are formed by the fabrication of glass tubing, and these containers, which include culture tubes that are widely used in scientific and laboratory applications, tend to have much thinner and more uniformly-formed walls and closure engaging rims than the blown containers that are used with closures according to the above-identified U.S. Patents. A thin-walled container, such as a culture tube, does not have sufficient width in its rim for proper sealing engagement with an internal sealing fin type of self-sealing closure, especially in the case of a small diameter culture tube, such as the 10 mm to 15 mm culture tubes which are especially popular for many laboratory and scientific applications. Additionally, thin-walled culture tubes are usually single use products, and need not be capable of being resealable. Thus, the resealability of the internal fin type of self-sealing closures, as described above, is not as important in a self-sealing closure for a culture tube as it is in the case of a closure for a liquor bottle, and certain economies may be realized in the production of closures for single use culture tubes by designs that would not meet the resealability requirements for liquor bottles and other multiple use containers.

Another type of self-sealing or linerless closure is depicted in U.S. Pat. No. 3,881,627 to Davolt. This closure utilizes an inner depending skirt which seals on a shoulder of a tooled inside surface portion of an associated plastic container, disclosed as being a vial. This closure has added complexity by virtue of the need for the inner sealing skirt, and can only be used with a special or non-standard vial, viz., one with the sealing shoulder to engage the inner sealing skirt of the closure and, apparently, this closure can only be used with plastic containers, possibly because manufacturing tolerances for glass containers are less precise, which could detract from the effectiveness of the inside surface seal provided by the inner sealing skirt of the closure.

SUMMARY OF THE INVENTION

According to the present invention, there is provided an unlined, molded thermoplastic closure that is capable of being affixed in a self-sealing manner to a standard container with a thin and accurately-formed closure engaging rim, such as a glass or plastic culture tube. Such a closure has a top panel which spans the open mouth of the container, and an annular skirt which extends downwardly from the central panel to closely surround the upper portion of the container and to removably engage such upper portion of the container, for example, by mating helical threads extending inwardly from the interior of the closure skirt and outwardly from the container, respectively. A central portion of the closure top panel is slightly depressed relative to a surrounding annular portion of the top panel that engages the closure skirt, and the central panel is connected to the surrounding annular portion by an upwardly tapering annular portion of reduced thickness.

When the closure is applied to the container, the rim of the container will engage the juncture between the tapering annular portion of reduced thickness and the surrounding annular portion. As a result of the tightening of the closure onto the container, the force of the rim of the container against this juncture will result in relatively high unit loadings due to the thinness of the container, and this will cause the tapering annular portion of the closure top panel to distort by partially wrapping around the top of the container rim to seal partially on the top of the rim and partially on the inside of the rim. The sealing of the closure partially on the inside of the container rim is enhanced by the taper of the tapering annular portion of the closure top panel, a factor which serves to reduce the angle between this portion of the closure top panel and the inside of the container rim, and by the reduced thickness of this portion of the closure top panel, a factor which makes it more reformable.

Accordingly, it is an object of the present invention to provide a novel, self-sealing closure, which seals at least partially on the inside of the associated container. More particularly, it is an object of the present invention to provide a self-sealing closure for a container with a thin and accurately formed closure engaging rim. More particularly, it is an object of the present invention to provide a self-sealing closure for a container which is formed by the fabrication of glass tubing. More particularly, it is an object of the present invention to provide a self-sealing closure for a small diameter, single use container with a thin and accurately formed closure engaging rim. More particularly, it is an object of the present invention to provide a self-sealing closure for a small diameter, single use culture tube. It is also an object of the present invention to provide a self-sealing closure for a standard container which is formed by the fabrication of glass tubing.

For a further understanding of the present invention and the objects thereof, attention is directed to the drawing and the description thereof, to the detailed description of the preferred embodiment, and to the appended claims.

DETAILED DESCRIPTION OF THE PREFERRED EMBODIMENT

Figure 2:
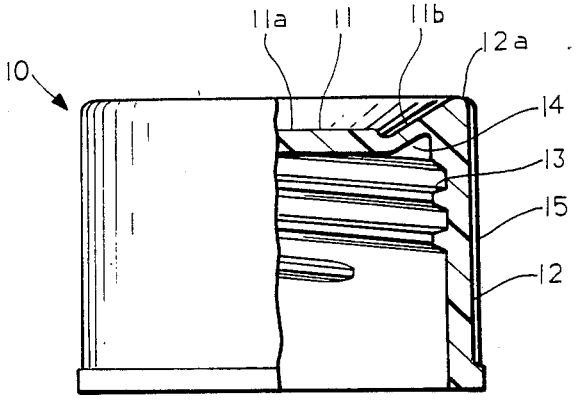
FIG. 2 is an offset sectional view taken along line 2—2 of FIG. 1.
Figure 1:
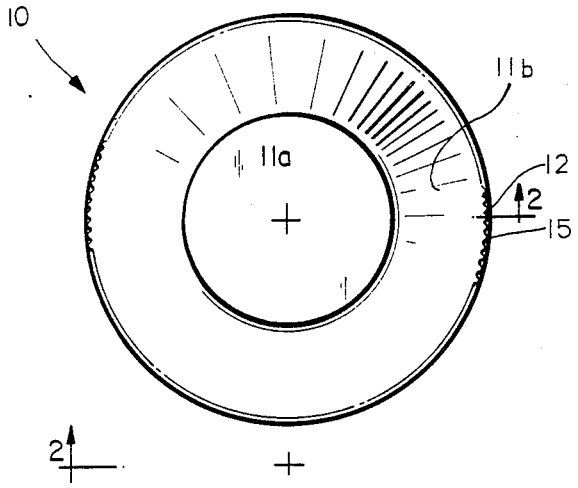
FIG. 1 is a plan view of a preferred embodiment of a closure according to the present invention.
Figure 3:
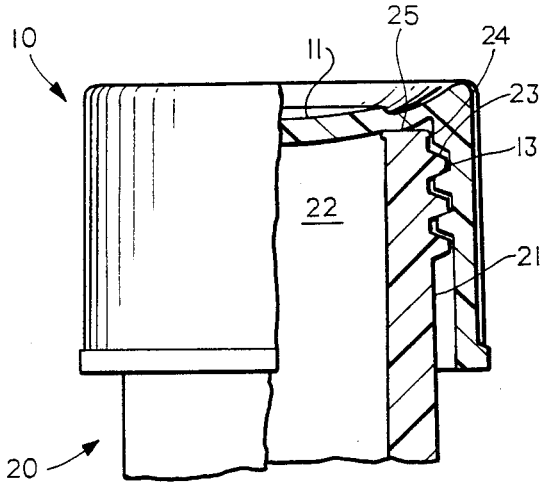
FIG. 3 is a view similar to FIG. 2, of the closure of FIGS. 1 and 2 after application to the finish of a container, shown fragmentarily.

A closure according to the present invention is indicated generally by reference numeral 10 in FIGS. 1 through 3, and in FIG. 3, the closure 10 is shown as being applied in closing relationship to a container, indicated generally by reference numeral 20, the container 20 being shown fragmentarily. The closure 10 includes a top panel 11 and an annular skirt 12, the top of which depends downwardly from the outer periphery of the top panel 11. The annular skirt 12 is provided with a radially inwardly extending helical thread 13, and as is shown in FIG. 3, the helical thread 13 on the closure 10 engages a radially outwardly projecting thread 23 on the upper or neck portion 21 of the container 20, a portion which is also known as a "finish" in the container art. When the closure 10 is affixed to the container 20 in closing relationship, as is shown in FIG. 3, the top panel 11 of the closure spans an open mouth 22 of the container 20 and the annular skirt 12 of the closure 10 surrounds the container finish 21, or at least the upper portion of the container finish which contains the helical thread 23.

The container 20 is preferably of a type which is formed in small sizes, with a finish diameter (the "T", or approximate outside diameter of the helical thread 23) of 15 mm or less. Disposable culture tubes with 10 mm to 15 mm finish diameters are widely used in laboratory and scientific applications, and containers of this type, which, when made of glass, are often made by the fabrication of a seamless glass tube. Small containers which are manufactured from a seamless glass tube, as described above, have a relatively thin wall 24 in the finish and a wall which is formed to closer manufacturing tolerances than the corresponding wall in a conventional blown-glass container. While the closure 10 may be used to particular advantage in combination with a single use or disposable glass culture tube, either of the flat bottom type or round bottom also to be understood the closure 10 may also be used to advantage with a disposable plastic culture tube, whenever the user desires to utilize a plastic culture tube rather than a glass culture tube, so long as the finish portion of such plastic culture tube has a thin-walled and accurately formed finish. It is to be noted here that many glass culture tubes are fire polished in the finish region, and this will somewhat round the inside and outside corners of the rim 25 of the container 20.

The top panel 11 of the closure 10 is made up of a central panel portion 11*a*, which is depressed from a top 12*a* of the annular skirt 12, and an annular portion 11*b* which surrounds the central panel portion 11*a* and extends radially outwardly and upwardly therefrom to merge with the annular skirt 12 of the closure 10 at the top 12*a* thereof. By this construction, the annular portion 11*b* of the top panel 11 forms a pocket 14 with the inside of the annular skirt 12, and the pocket 14 sealingly engages the uppermost portion of the container finish 21 when the closure is applied to the container, as is shown in FIG. 3. As is shown in FIGS. 2 and 3, the thickness of the annular skirt portion 11*b* of the closure top panel 11 is substantially less than the thickness of the central panel portion 11*a*, to impart improved flexibility or deformability to finish contacting areas of the closure when the closure is tightened onto the associated container 20, as is shown in FIG. 3. This permits the closure top panel 11 to seal against the top of the finish portion 21 of the container 20 on the top of such finish portions and at least partially on the inside surface of the container finish at the uppermost portion thereof. Such a sealing technique is important in the case of small containers with thin-walled and accurately formed finishes, because such containers do not provide suitable uppermost sealing surfaces for use with the prior art types of closures that have been successfully used in sealing on the uppermost sealing surfaces of blown-glass containers.

The closure 10 is molded as a single piece from a suitable thermoplastic material, having regard to avoiding undue manufacturing costs and having regard to providing a closure with sufficient deformability to be able to seal in the manner described above. Having regard to these factors, it is preferred that the closure be molded by injection molding or compression molding and that the principal ingredient of the material utilized in the closure by either high density polyethylene or polypropylene, it being noted that suitable plasticizers, coloring ingredients, and the like may be added to the basic polymer during its manufacture or during the extrusion process, which is an intergal part of an injection molding or compression molding operation. In the case of a closure for a 13 mm disposable culture tube, i.e., a closure with a "T" dimension, or thread inside diameter, of approximately 13 mm, in the preferred embodiment such closure is molded from polypropylene with a thickness of the central panel portion 11*a* of the closure top panel 11 of approximately 0.045 inch, and with a thickness of the annular skirt portion 11*b* of the closure top panel 11 of approximately 0.025 inch. Such a closure may also be advantageously provided with a multiplicity of narrow radially projecting ribs 15 on the outside surface of the annular skirt 12 to facilitate the gripping of the closure during application and removal. Such a closure is also advantageously molded in the inverted position to insure that the residual memory of the plastic in the closure 10 will tend to keep the top panel 11 depressed relative to the top 12*a* of the annular skirt 12.

Figure 4:
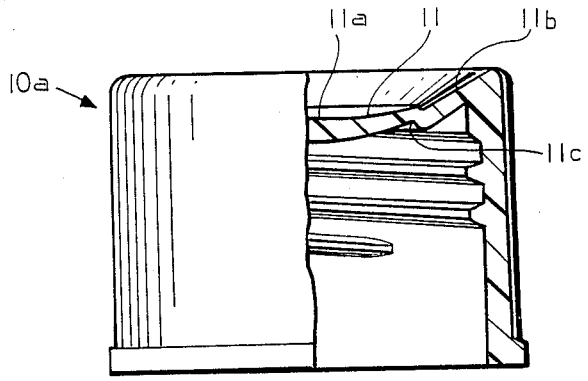
FIG. 4 is a view similar to FIG. 2 of an alternative embodiment of a closure according to the present invention.
Figure 5:
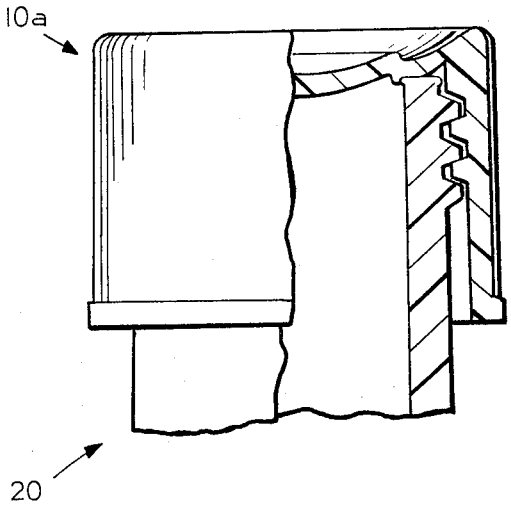
FIG. 5 is a view similar to FIG. 3 of the closure of FIG. 4 after application to the finish of a container, shown fragmentarily.

FIG. 4 illustrates an alternative embodiment of a closure according to the present invention, and the alternative closure is indicated generally by reference character 10*a*. The alternative closure 10*a*, which is otherwise the same as the closure 10, has a top panel 11 in which the underside of the central panel portion 11*a* is separated from the annular skirt portion 11*b* by an annular undercut region 11*c*. This helps to bunch up some of the plastic material in the closure on the inside of the container rim 25 when the closure 10*a* is applied to the container 20, as is shown in FIG. 5.

This invention, and the manner and process of making it and using it, has been described above in terms sufficiently full, clear, concise, and exact as to enable any person skilled in the art to make and use the same, and the best mode contemplated by the inventor for carrying out the invention has been set forth. It is to be understood, however, that it is contemplated that certain modifications of the above described invention, and/or the best mode of carrying out the invention can be made by a skilled artisan without departing from the scope of the invention, and it is, therefore, desired to limit the invention only in accordance with the appended claims.

What is claimed is:

1. A package comprising, in combination:

a container comprising an open mouth, a finish surrounding said open mouth, and a helical thread projecting outwardly from said finish, said finish having a thin and accurately formed top, the outside diameter of said helical thread being not substantially greater than 15 millimeters; and a molded thermoplastic linerless closure sealingly engaging said container, said closure further comprising:

a top panel spanning said open mouth of said container;

an annular skirt integrally formed with said top panel and surrounding at least the upper portion of said finish; and a helical thread integrally formed with said top panel and said annular skirt and projecting inwardly from said annular skirt and engaging said helical thread on said finish to removably secure said closure to said container;

wherein said top panel of said closure comprises a central portion which is depressed from the top of said annular skirt of said closure to lie within said open mouth of said container;

wherein said top panel of said closure further comprises an annular portion surrounding said central portion and extending radially outwardly and upwardly from said central portion to said top of said annular skirt; and said annular portion of said top panel of said closure and said top of said annular skirt of said closure forming a pocket, said pocket sealingly engaging the top of said finish of said container and a portion of the inside surface of said finish of said container.

2. The package according to claim 1 wherein said closure is molded from a thermoplastic material whose principal ingredient is selected from the group consisting of high density polyethylene and polypropylene.

3. The package according to claim 2 wherein said closure is molded by a process which includes a molding step that is selected from the group consisting of injection molding and compression molding.

4. The package according to claim 3 wherein said closure is molded in the inverted position.

5. The package according to claim 1 wherein the thickness of said annular portion of said top panel of said closure is substantially less than the thickness of said central portion of said top panel of said closure, to facilitate the deforming of said annular portion and the sealing of said inside surface of said finish of said container by said annular portion of said top panel of said closure when said pocket engages said top of said container.

6. The package according to claim 5 wherein the underside of said top panel of said closure is undercut in an annular pattern at the juncture of said central portion and said annular portion.

7. The package according to claim 1 wherein said container is produced by the reforming of a tube.

8. The package according to claim 1 wherein said container is a glass culture tube.

9. The package according to claim 1 wherein said container is a plastic culture tube.

10. The package according to claim 5 wherein said container is produced by the reforming of a tube.

11. The package according to claim 10 wherein said container is a glass culture tube.

12. The package according to claim 5 wherein said container is a plastic culture tube.

13. The package according to claim 7 wherein said container is a single use container.

14. The package according to claim 10 wherein said container is a single use container.

15. A molded thermoplastic linerless closure for sealing attachment to the finish of a small container, said finish surrounding the open mouth of said container, having a helical thread projecting outwardly therefrom, and having a thin and accurately formed top, said closure comprising:

a top panel adapted to span said open mouth of said container;

an annular skirt integrally formed with said top panel and adapted to surround at least the upper portion of said finish of said container; and a helical thread integrally formed with said top panel and said annular skirt and projecting inwardly from said annular skirt and adapted to engage said helical thread on said finish to removably attach said closure to said container, the inside diameter of said helical thread of said closure being not substantially greater than 15 millimeters;

wherein said top panel of said closure further comprises:

a central portion which is depressed from the top of said annular skirt of said closure and is adapted to lie within said open mouth of said container; and an annular portion surrounding said central portion and extending radially outwardly and upwardly from said central portion to said top of said annular skirt;

said annular portion of said top panel of said closure and said annular skirt of said closure forming a pocket, said pocket being adapted to sealingly engage said top panel and a portion of the inside surface of said finish of said container.

16. The closure according to claim 15 wherein said closure is molded from a thermoplastic material whose principal ingredient is selected from the group consisting of high density polyethylene and polypropylene.

17. The closure according to claim 16 wherein said closure is molded by a process including a molding step that is selected from the group consisting of injection molding and compression molding.

18. The closure according to claim 17 wherein said closure is molded in the inverted position.

19. The closure according to claim 15 wherein the thickness of said annular portion of said top panel is substantially less than the thickness of said central portion, to facilitate the deforming of said annular portion and the sealing of said inside surface of said finish of said container when said pocket engages said top of said container.

20. The closure according to claim 19 wherein the underside of said top panel of said closure is undercut in an annular pattern at the juncture of said central portion and said annular portion.

21. The closure according to claim 18 wherein the thickness of said annular portion of said top panel is substantially less than the thickness of said central portion, to facilitate the deforming of said annular portion and the sealing of said inside surface of said finish of said container when said pocket engages said top of said container.

22. The closure according to claim 21 wherein the underside of said top panel of said closure is undercut in an annular pattern at the juncture of said central portion and said annular portion.

* * * * *